United States Patent [19]

Cane

[11] Patent Number: 4,553,807

[45] Date of Patent: Nov. 19, 1985

[54] SEPARABLE ELECTRICAL CONNECTORS WITH FLUID ESCAPE PATH

[75] Inventor: Michael R. Cane, Prescot, England

[73] Assignee: BICC Public Limited Company, England

[21] Appl. No.: 588,707

[22] Filed: Mar. 12, 1984

[30] Foreign Application Priority Data

Mar. 31, 1983 [GB] United Kingdom ..... 8308978

[51] Int. Cl.[4] ..... H01R 13/523

[52] U.S. Cl. ..... 339/94 R; 339/117 R

[58] Field of Search ..... 339/94 R, 94 C, 94 M, 339/115 R, 115 C, 117 R, 117 P

[56] References Cited

U.S. PATENT DOCUMENTS 3,059,210 10/1962 Luenberger ..... 339/94 R
3,241,095 3/1966 Phillips ..... 339/117 R
3,772,636 11/1973 Webb ..... 339/117 R

FOREIGN PATENT DOCUMENTS 792382 12/1980 U.S.S.R. ..... 339/117 R

*Primary Examiner*—Neil Abrams

*Attorney, Agent, or Firm*—Parkhurst & Oliff

[57] ABSTRACT

A separable electric connector for use "downhole" in the oil industry or else where when large pressure changes are encountered comprises a socket part which, prior to the assembly of the part, can be filled with a viscous insulating fluid. The corresponding plug part has a tubular member which is closed at one end and surrounds the socket part with a clearance when the connector is assembled. A male member which forms or carries contacts is upstanding from the closed end of the tubular member to enter the socket part and make the required contact or contacts. A passage is provided to allow flow of the fluid from the socket member into the space within the tubular member. A sleeve member subsequently enters the tubular member, whereupon the fluid flows mainly between the sleeve member and the tubular member until a seal is formed, for instance by a sealing ring. An escape path is formed, as between the socket member and the sleeve member, to allow the subsequent escape of excess fluid. In this way air is reliably purged from the spaces between the parts of the connector.

4 Claims, 4 Drawing Figures

SEPARABLE ELECTRICAL CONNECTORS WITH FLUID ESCAPE PATH

Figure 1:
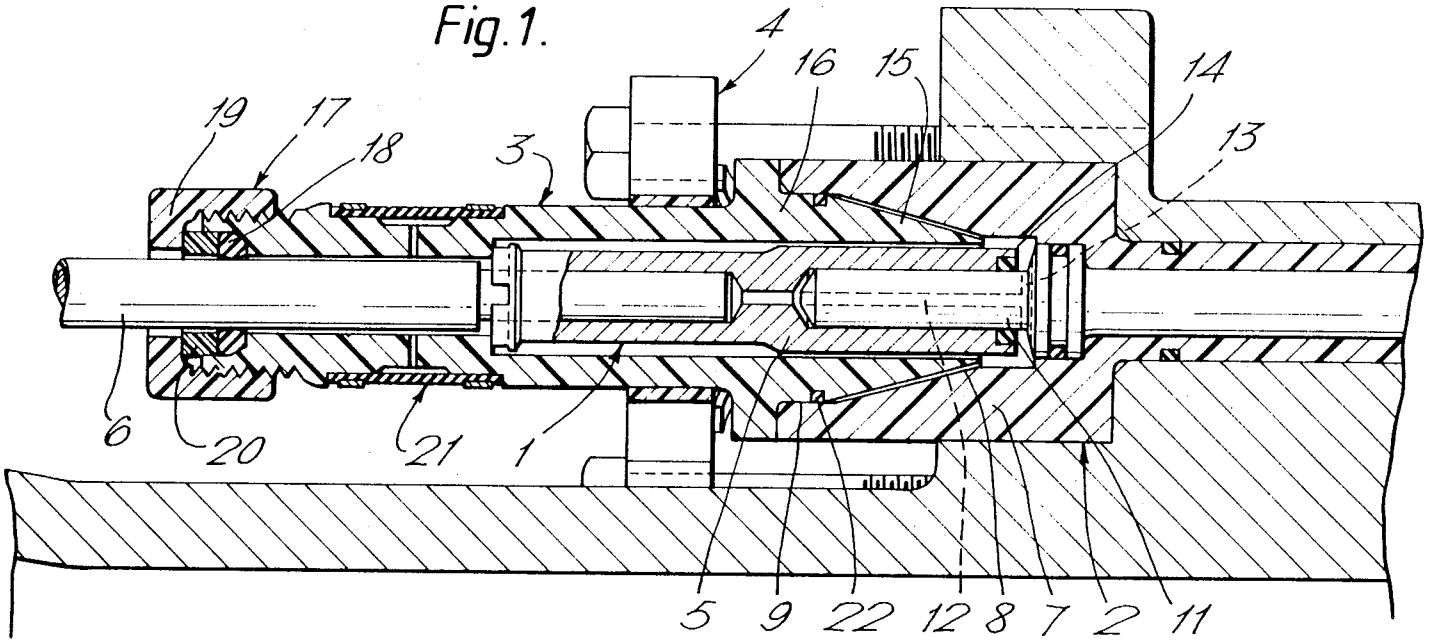

This invention relates to separable electric connectors capable of withstanding large changes in ambient pressure and possibly also in ambient temperature. An important application is to the connection of submersible electric pumps for "downhole" operation in the oil industry where conditions ranging from atmospheric to 28 $MN/m^2$ (4130 psi) and 150° C. are likely to be encountered.

Because leakage into or out of the connector is likely to result in electrical failure, it is desirable for the pressure inside the connector to be always substantially the same as that outside, and so it is desirable to eliminate as far as possible all air spaces not only within the separable parts of the connector but especially between them.

In accordance with the invention, a separable electric connector comprises:

- a socket part which, prior to the assembly of the parts, can be filled with a viscous insulating fluid;
- a plug part having
  - (a) a tubular member which is closed at one end and surrounds the socket part with a clearance when the connector is assembled and
  - (b) a male member upstanding from the closed end of the tubular member to enter the socket part and make at least one electrical contact with it;

there being at least one passage allowing flow of the viscous insulating fluid from the socket part into the tubular member adjacent its closed end as the socket part and the plug part are brought together;

- a sleeve part surrounding the socket part and capable of entering the tubular member to displace the viscous insulating fluid therefrom;
- means for forming a seal between the tubular member and the sleeve member after the space between them has been filled with the fluid but before they are fully assembled;
- and an escape path for passage of fluid after that seal has been formed.

The escape path may be formed wholly by the clearance between the sleeve member and the socket member; and in all cases the cross-section of the escape path is preferably small compared with the clearance, prior to sealing, between the sleeve member and the tubular member, so that little fluid flows through it before the seal is formed.

By a "viscous insulating fluid" is meant a medium (other than a gas or mobile liquid) that is electrically insulating and can be made to flow; for example the fluid may be a viscous liquid, a grease or a pasty insulating compound.

Preferably separate means are provided for sealing the sleeve member, at its exposed end, to the socket member after the parts are assembled but this is not always essential; a non-return valve may be used as an alternative.

The passage for flow of the viscous insulating fluid from the socket into the tubular member may extend through the male member, through the socket, or between them.

The socket part may be a simple electrical socket, in which case the male member will normally be an electrical plug with at least one internal passage or surface groove to provide for flow of the fluid. Alternatively, however, the socket part may be an insulating, or appropriately insulated, member supporting one or more than one electric contact which may be of plug, socket, stud, blade or any other type, or types, suited to the particular application.

Preferably the end of the sleeve member that enters the tubular member comprises a tapered end-part and a parallel-sided adjacent part, and the interior of the tubular member is of corresponding shape, the respective parallel-sided parts engaging to provide the seal between the parts when required, preferably in conjunction with an elastomeric sealing ring.

Figure 2:
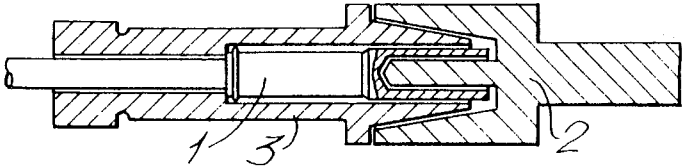
Figure 3:
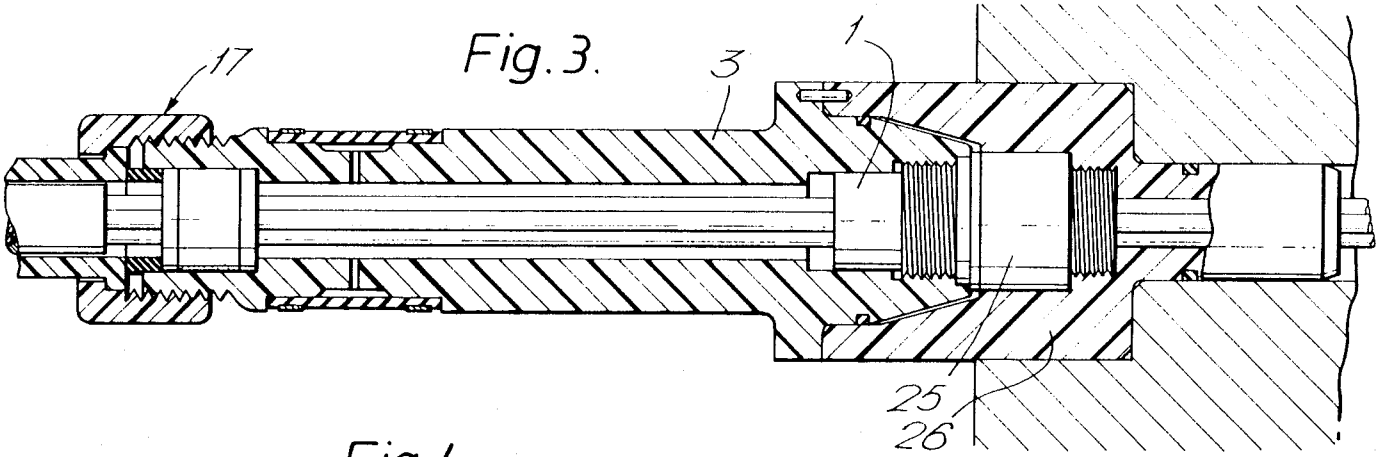
Figure 4:
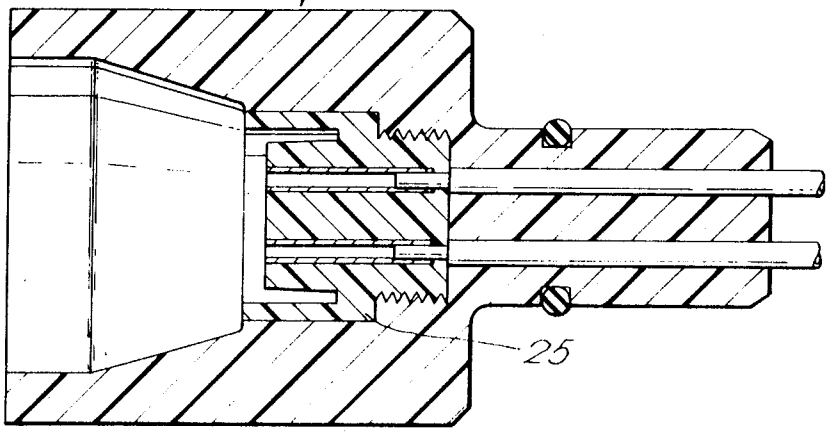
Figure 4:
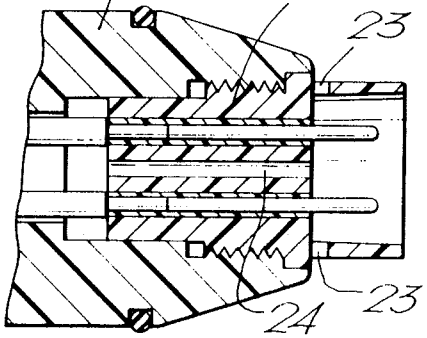

The invention will be further described by way of example with reference to the accompanying drawings in which:

FIG. 1 is a longitudinal cross-section of a single core connector in accordance with the invention, FIG. 2 is a reduced, diagrammatic version of FIG. 1, FIG. 3 is a similar cross-section of a multi-core connector in accordance with the invention and FIG. 4 is an enlarged detail of the connector shown in FIG. 3, seen with the parts separated.

The connector of FIG. 1 consists essentially of a socket part 1, a plug part 2 and a sleeve part 3 (which will be more easily identified by reference to FIG. 2) together with clamping means 4 for holding the parts together.

The socket part 1 comprises a simple metallic socket 5 soldered, crimped or otherwise connected to the single conductor of a cable 6.

The plug part 2 includes a tubular member 7, which coaxially surrounds the socket part when the connector is assembled as shown. This is closed at its right hand end (as drawn) and comprises a frusto-conical tapered portion 8 and a parallel-sided portion 9 forming its open left-hand end. Upstanding from its closed end is a metallic plug contact 11 which is conventional except that it has an axial bore 12 connecting with at least one cross bore 13 at the base of the plug and together with it forming a through passage between the interior of the socket 5 and the space 14 within the tubular member 2. For heavy-current applications, silver plated copper contact foils may be interposed between the pin and the socket.

The sleeve member 3 has a tapered end portion 15 and a parallel sided portion 16 which conform closely to the parts 8 and 9 respectively of the tubular member. At its opposite end, a conventional seal 17 comprising an elastomeric ring 18 and gland nut 19 with a skid washer 20 provides for sealing to the cable. The sleeve member is also fitted with a pressure equalising device 21 which is the subject of a separate patent application Ser. No. 588,807 being filed on the same day as this application claiming priority from British Patent Application No. 8308977.

In use, the assembled sleeve member 3 is passed over the end of the cable 6 before the socket member 1 is attached to it. The interior of the socket 5 is filled with a suitable electrically insulating compound and, with the sleeve member withdrawn to the left as seen in the drawing, the tubular member is advanced and the plug 11 inserted into the socket. Apart from the small volume required to fill remaining clearances, the whole of the compound flows through the bores 12 and 13 and into the space 14. Air is thus eliminated from within the socket member. The sleeve member 3 is now advanced towards the position shown in the drawing, its front end entering the compound contained in the space 14 and initially displacing the bulk of it outwards so as to displace air from between the sleeve member and the tubular member. As the parallel sided parts 9 and 16 begin to be engaged however an oil resisting rubber sealing ring 22 seals the passage between those parts, and continued advance of the sleeve member 3 forces the remaining excess of fluid through the clearance between the socket 5 and the sleeve member 3 itself. Provided the volume of free space in this clearance is sufficiently small, any air will be displaced through the seal 17, after which that seal is completed by tightening the nut 19. In this way a substantially complete elimination of air from the connector is achieved.

The connector shown in FIGS. 3 and 4 differs in a number of minor respects. The socket member 1 is in this case a commercially available multipin connector, sold by BICC-Vero Connectors Limited under the designation TR1208PMS-1NB, with the locking ring removed and with a number of small passages 23 formed at the base of the socket. These provide the required passage for compound from the socket into the surrounding space. Because in this case the clearance between the plastics body of the socket 1 and the sleeve member 3 is very small, one of the eight contact bores provided in the connector is left open to provide a major part 24 of the escape path. The male member 25 is identical with the socket sold by BICC-Vero Connectors Limited under the designation TR1208S-1NB except that the external shape is simplified to facilitate mounting in the body of the tubular member 26 and the contact bore corresponding to the passage 24 in the socket member is omitted.

The form of the seal 17 is modified to suit the type of cable.

The mode of assembly and function are substantially the same as for the connector of FIG. 1, but in this case the space within the sleeve member 3 needs to be prefilled with compound, and there is a slightly increased risk that very small volumes of air will remain within the connector body, but not in the interface between the plug and socket parts.

What I claim as my invention:

1. A separable electric connector comprising three relatively movable parts, namely:

a socket part formed about an axis and which, prior to the assembly of the parts, is to be filled with a viscous insulating fluid;

a plug part having (a) a tubular member which is closed at one end and surrounds the socket part with a clearance when the connector is assembled and (b) a male member upstanding from the closed end of the tubular member to enter the socket part and make at least one electrical contact with it;

there being at least one passage allowing flow of the viscous insulating fluid from the socket part into the tubular member adjacent its closed end as the socket part and the plug part are brought together; and a sleeve part surrounding the socket part, axially movable relative thereto and capable of entering the tubular member to displace the viscous insulating fluid therefrom; said connector further comprising:

means for forming a seal between the tubular member and the sleeve part after the space between them has been filled with the fluid but before they are fully assembled;

and an escape path other than between the tubular member and the sleeve part which permits passage of fluid from said space to the exterior of the connector as said three relatively movable parts are brought from a seal-forming position to a fully-assembled position, the fluid to be forced through the escape path by axial movement of the sleeve part relative to the socket part and into the tubular member.

2. A connector as claimed in claim 1 in which the escape path is formed wholly by a clearance between the sleeve member and the socket member.

3. A connector as claimed in claim 1 in which the end of the sleeve member that enters the tubular member of the plug part comprises a tapered end part and a parallel-sided adjacent part and the interior of the tubular member is of corresponding shape, the respective parallel-sided parts engaging to provide the seal between the parts when required.

4. A connector as claimed in Claim 3 in which the said seal also comprises an elastomeric sealing ring.

* * * * *